US012716355B2

(12) United States Patent
De Bruyne et al.

(10) Patent No.: US 12,716,355 B2
(45) Date of Patent: Aug. 25, 2026

(54) DEEP-SEA MINING VEHICLE

(71) Applicant: Deeptech NV, Ostend (BE)

(72) Inventors: Kris De Bruyne, Antwerp (BE); Harm Stoffers, Dorst (NL); Stéphane Flamen, Antwerp (BE); Hendrik De Beuf, Ostend (BE)

(73) Assignee: Deeptech NV, Ostend (BE)

( * ) Notice: Subject to any disclaimer, the term of this patent is extended or adjusted under 35 U.S.C. 154(b) by 864 days.

(21) Appl. No.: 17/801,065

(22) PCT Filed: Feb. 19, 2021

(86) PCT No.: PCT/IB2021/051447
§ 371 (c)(1),
(2) Date: Aug. 19, 2022

(87) PCT Pub. No.: WO2021/165920
PCT Pub. Date: Aug. 26, 2021

(65) Prior Publication Data

US 2023/0082082 A1 Mar. 16, 2023

(30) Foreign Application Priority Data

Feb. 20, 2020 (BE) ..... 2020/5116

(51) Int. Cl.
*E21C 50/00* (2006.01)
*E02F 3/88* (2006.01)
(Continued)

(52) U.S. Cl.
CPC ..... *E21C 50/00* (2013.01); *E02F 3/88* (2013.01); *E02F 3/8866* (2013.01); *E02F 3/907* (2013.01); *E02F 5/006* (2013.01)

(58) Field of Classification Search
CPC ..... E21C 50/00; E02F 3/88; E02F 3/8833; E02F 3/885; E02F 3/905; E02F 3/907; E02F 5/006
See application file for complete search history.

(56) References Cited

U.S. PATENT DOCUMENTS 3,589,040 A * 6/1971 De Koning ..... E02F 3/907 37/906
3,672,725 A * 6/1972 Johnson ..... E02F 7/00 299/8
(Continued)

FOREIGN PATENT DOCUMENTS

CN 105735999 A * 7/2016 ..... E21C 50/00
CN 205743909 U 11/2016
(Continued)

*Primary Examiner* — Christopher J Sebesta
*Assistant Examiner* — Audrey L Lusk
(74) *Attorney, Agent, or Firm* — The Webb Law Firm

(57) ABSTRACT

Described is a deep-sea mining vehicle for taking up mineral deposits from a seabed at great depth, and optionally transporting said deposits to a floating device. The vehicle includes a support frame provided with means for moving the vehicle forward on the seabed, a storage for the mineral deposits taken up, and further a suction head with an open suction side which is directed toward the seabed and along which the mineral deposits are taken up. The deep-sea mining vehicle is further provided with a control device for keeping the height of the suction plane within predetermined limits relative to the seabed. The control device makes use of measuring means for obtaining seabed heights at positions which precede the open suction side relative to the direction of movement and which extend over a width of the deep-sea mining vehicle. An actuator which is incorporated in a control circuit adjusts the height of the suction head on the basis of the seabed heights measured at the positions.

19 Claims, 6 Drawing Sheets

(51) Int. Cl.
*E02F 3/90* (2006.01)
*E02F 5/00* (2006.01)

(56) References Cited

U.S. PATENT DOCUMENTS 3,971,593 A * 7/1976 Porte ..... E21C 50/00 299/8
3,978,679 A * 9/1976 Lecomte ..... E02F 5/108 37/308
4,035,022 A * 7/1977 Hahlbrock ..... E21C 50/00 299/8
4,232,903 A * 11/1980 Welling ..... E02F 3/8858 37/312
4,311,342 A * 1/1982 Latimer ..... E02F 9/2866 299/8
4,357,764 A * 11/1982 Lemercier ..... E02F 7/005 114/313
4,374,420 A * 2/1983 Wolters ..... E02F 9/2045 37/308
4,387,519 A * 6/1983 Loevendie ..... G01V 1/3817 37/309
4,418,484 A * 12/1983 Wolters ..... E02F 3/8841 37/195
4,503,629 A * 3/1985 Uchida ..... E02F 7/005 37/313
5,865,568 A * 2/1999 Relin ..... B65G 53/24 417/306
6,357,149 B1 * 3/2002 Satzler ..... E02F 3/26 405/17
9,309,642 B2 * 4/2016 Patriciu ..... E02F 3/92
9,874,000 B2 * 1/2018 Heiler ..... E21C 50/00
2014/0283420 A1 9/2014 Patriciu
2015/0047233 A1 * 2/2015 Hong ..... E02F 7/065 37/313
2016/0122969 A1 * 5/2016 Noborio ..... E02F 9/262 701/50
2016/0222624 A1 * 8/2016 Wagner ..... E02F 3/431

FOREIGN PATENT DOCUMENTS

CN 106907154 A 6/2017
CN 105735999 B 5/2018
CN 105952457 B 9/2018
DE 2434411 A1 2/1975
EP 0007921 A1 2/1980
EP 0018891 B1 3/1983
JP 201635174 A 3/2016
KR 101391634 B1 5/2014
WO 2013050136 A1 4/2013

* cited by examiner

DEEP-SEA MINING VEHICLE

CROSS-REFERENCE TO RELATED APPLICATIONS

This application is the United States national phase of International Application No. PCT/IB2021/051447 filed Feb. 19, 2021, and claims priority to Belgian Patent Application No. 2020/5116 filed Feb. 20, 2020, the disclosures of which are hereby incorporated by reference in their entirety.

BACKGROUND OF THE INVENTION

Field of the Invention

The invention relates to a deep-sea mining vehicle for collecting mineral deposits on a seabed at great depths and transporting said deposits to a floating device or other storage above water. The invention likewise relates to a method for collecting mineral deposits at great depths with the deep-sea mining vehicle, and to a suction head for use in a deep-sea mining vehicle. The mineral deposits can comprise polymetallic nodules, such as manganese nodules.

Description of Related Art

In view of the growing world population and increasing scarcity of natural resources, there is an increasing need for groundbreaking technologies for deep-sea mining Polymetallic nodules occur on the floors of a number of oceans and contain essential raw materials, such as nickel, cobalt and manganese. After extraction, the metals present in the polymetallic nodules can for instance be applied in stainless steel, batteries, wind turbines, photovoltaic systems and other useful applications.

In deep-sea mining the seabed can lie a distance of 4000-6000 m and more from the sea surface, and deep-sea mining devices must therefore be able to withstand the high pressures and other difficult conditions prevailing at such depths in the vicinity of the seabed.

A deep-sea mining vehicle is generally lowered toward the seabed from a deep-sea mining ship. Use can be made here of launching devices designed particularly for this purpose, which can if desired be adapted to the design of the deep-sea mining vehicle. A riser pipe or riser string arranged between the deep-sea mining vehicle and the deep-sea mining ship further ensures that mineral deposits collected by the deep-sea mining vehicle are carried from the seabed to a storage situated above the water surface. For this purpose the deep-sea mining ship is provided with suitable pumping equipment. If desired, pumps can also be incorporated in the riser string at determined water depths. A flexible connection between the riser string and the deep-sea mining vehicle ensures that the vehicle is able to move relatively freely over the seabed.

U.S. Pat. No. 4,311,342 A discloses a deep-sea mining vehicle, comprising a level sensor shoe for measuring seabed heights. An actuator system uses the measured seabed heights for controlling the height of the suction head.

CN 105735999 B, EP 0018891 B1 and WO 2013/050136 A1 disclose similar deep-sea mining vehicles.

It will be apparent that collecting polymetallic nodules and then transporting the collected polymetallic nodules to a floating device above the water surface must take place as efficiently as possible, considering the difficult conditions on site.

SUMMARY OF THE INVENTION

The present invention has for its object, among others, to provide a deep-sea mining vehicle whereby mineral deposits can be collected at great depths with an increased efficiency relative to the prior art.

For this purpose the invention comprises a deep-sea mining vehicle as described herein. The deep-sea mining vehicle for taking up mineral deposits from a seabed at great depth, and optionally transporting said deposits to a floating device, comprises a support frame provided with means for moving the vehicle forward on the seabed in a direction of movement, with a storage for the mineral deposits taken up, and further with at least one suction head with an open suction side which is directed toward the seabed and is provided in a suction plane, and along which the mineral deposits are taken up, wherein a width direction of the at least one suction head coincides with a width direction of the deep-sea mining vehicle, wherein the deep-sea mining vehicle is further provided with a control device for keeping the height of the suction plane within predetermined limits relative to the seabed, wherein the control device comprises measuring means for obtaining seabed heights at positions which precede the open suction side relative to the direction of movement and which extend over a width of the deep-sea mining vehicle, and further an actuator which is incorporated in a control circuit and which is configured on the basis of the seabed heights measured at the positions to adjust the height of the suction plane of the at least one suction head such that it remains between the predetermined limits relative to the seabed.

According to the invention, the height of the suction plane of the at least one suction head is kept between predetermined limits relative to the seabed. It has been found that this measure increases the efficiency with which mineral deposits are taken up from the seabed.

In the context of the present invention efficiency is understood to mean the quantity by weight of mineral deposits taken up per unit of power.

An embodiment of the invention relates to a deep-sea mining vehicle, wherein the measuring means comprise an elongate carrier which precedes the open suction side relative to the direction of movement, wherein the carrier is provided with a series of sources configured to generate a geophysical signal under water in the direction of the seabed, and with a series of receivers configured to measure a response signal returning via the seabed, wherein the carrier extends in the width direction of the deep-sea mining vehicle over a width of the deep-sea mining vehicle.

In yet another embodiment of the invention are deep-sea mining vehicle is provided wherein the geophysical signal comprises a sound wave.

A further embodiment is obtained by a deep-sea mining vehicle wherein the measuring means comprise a multibeam. A multibeam is per se known and is for instance used to map the topography of the seabed. A multibeam system transmits sound waves in the form of a fan, i.e. at different angles. The amount of time it takes for the sound waves to be sent back from the seabed to receivers is used to determine the water depth. In contrast to other sonar systems, multibeam systems use beamforming in order to derive directional information from the returning sound waves.

Another embodiment relates to a deep-sea mining vehicle wherein the number of positions of which the seabed height is measured lies in width direction between 1 and 400, more preferably between 100 and 350, still more preferably between 200 and 300. With these measures a relatively complete image is obtained of the seabed topology and any foreign objects which may be present on the seabed and must be avoided.

Yet another embodiment relates to a deep sea mining vehicle wherein the intermediate distance of two adjacent positions of which the seabed height is measured lies in width direction between 1 and 3 cm, more preferably between 1.2 and 2.5 cm, still more preferably between 1.4 and 2 cm. The intermediate distance of two adjacent positions claimed in this embodiment is not essential to the invention and can be chosen differently if desired.

In a further improved embodiment a deep-sea mining vehicle is provided wherein the at least one suction head has a width, the seabed heights measured in the width direction of the deep sea mining vehicle are filtered of outlying values, a subset of seabed heights over the width of the at least one suction head is determined, and a maximum seabed height over the width of the at least one suction head is calculated from the subset, wherein the actuator is configured on the basis of the calculated maximum seabed height to adjust the height of the suction plane of the at least one suction head such that it remains between the predetermined limits relative to the seabed.

Yet another embodiment provides a deep-sea mining vehicle comprising at least two suction heads disposed parallel to each other in the width direction of the deep-sea mining vehicle, and more preferably comprising 2 to 16 suction heads, more preferably 10 to 16 suction heads. The amount of suction heads claimed in this embodiment is not essential to the invention and this amount can be chosen differently if desired.

A further optimized deep-sea mining vehicle has the feature that the suction heads are controlled individually in the height relative to the seabed.

A deep-sea mining vehicle according to yet another embodiment has the feature that the predetermined limits amount to 0 and 200 mm, and more preferably 20 and 100 mm.

In an embodiment of the deep-sea mining vehicle the measuring means precede a front side of the open suction side of the at least one suction head relative to the direction of movement by a preceding distance lying between 20 cm and 250 cm, more preferably between 50 cm and 200 cm, and most preferably between 80 cm and 150 cm.

Another embodiment provides a deep-sea mining vehicle comprising further measuring means for obtaining seabed heights at positions which precede the open suction side relative to the direction of movement and which extend over a width of the deep-sea mining vehicle, wherein the further measuring means comprise a slat which is connected to the frame and can move over the seabed in the direction of movement, and further comprise computing means for determining a seabed height from the measured incline of the slat.

It is advantageous here for the slat to be removable from the seabed in the deep-sea mining vehicle according to an embodiment.

According to yet another aspect of the invention, a method is provided for taking up mineral deposits on a seabed at great depth and optionally transporting said deposits to a floating device. The method comprises of providing a deep-sea mining vehicle according to the invention, connecting the deep-sea mining vehicle to a suspension cable provided between the floating device and the deep-sea mining vehicle, lowering the deep-sea mining vehicle toward a seabed, and moving the deep-sea mining vehicle forward over or on the seabed in order to take up the mineral deposits.

The embodiments of the invention described in this patent application can be combined in any possible combination of these embodiments, and each embodiment can individually form the subject-matter of a divisional patent application.

BRIEF DESCRIPTION OF THE FIGURES

The invention will now be further elucidated on the basis of the following figures and description of a preferred embodiment, without otherwise being limited thereto. In the figures.

DESCRIPTION OF THE INVENTION

Figure 1:
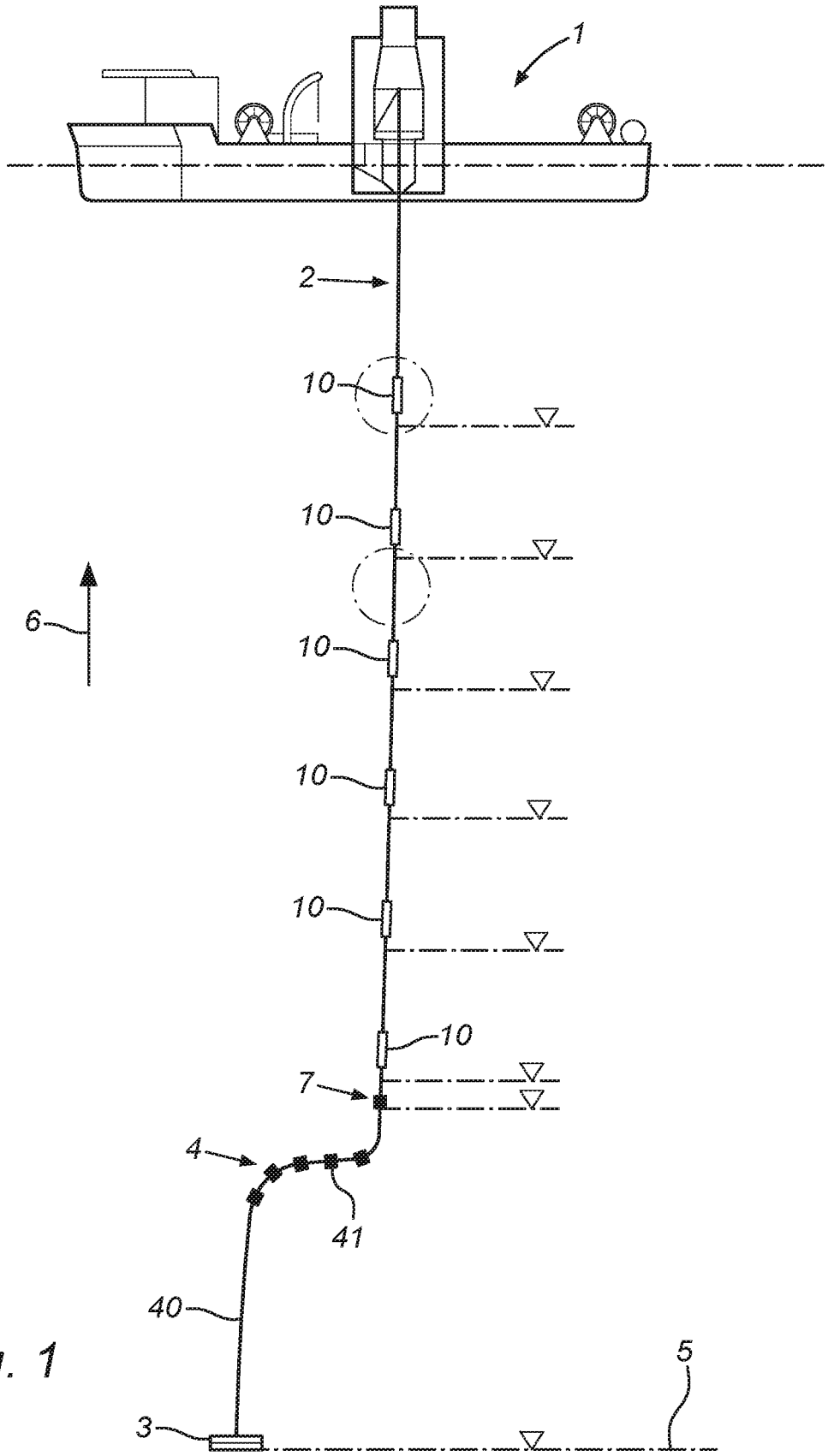
FIG. 1 is a schematic side view of an assembly of a floating vessel and a riser pipe connected thereto, to an underside of which is connected a deep-sea mining vehicle according to embodiment of the invention.

Referring to FIG. 1, a part is shown of a typical setup which is used in deep-sea mining of mineral deposits, such as polymetallic nodules. The setup typically comprises a transport system in the form of a tubular riser string 2 (which can have a length of several thousands of metres and connects to a floating vessel 1) to which mining equipment such as a deep-sea mining vehicle 3 is attached. A flexible connecting hose assembly 4 can be arranged between the lower end 7 of riser pipe 2 and the deep-sea mining vehicle 3 which is adapted to move on a deep-sea floor 5 and to collect mineral deposits therefrom.

Connecting assembly 4 comprises a flexible undersea hose 40 which is adapted to transport mineral nodules collected by vehicle 3 to the rigid riser pipe 2. Hose 40 can be provided with floating blocks 41 which compensate for the components' own weight and generate an upward force in a part of the hose and create an S-shape. Flexible connecting assembly 4 enables mining vehicle 3 to have a determined degree of freedom to move around on seabed 5, and ensures that the vehicle is not affected by the movements of riser pipe 2. In order to support and lift vehicle 3 steel hoisting cables (not shown) can be provided between the vessel 1 and the deep-sea mining vehicle 3.

If desired, the transport system in the form of a tubular riser string 2 of extreme length can also comprise a number of pump modules 10 which are arranged in lengthwise direction. Pump modules 10 are adapted to pump up mineral deposits (nodules) from seabed 5 in an upward direction 6, which is oriented away from seabed 5 toward the sea surface.

Figure 2:
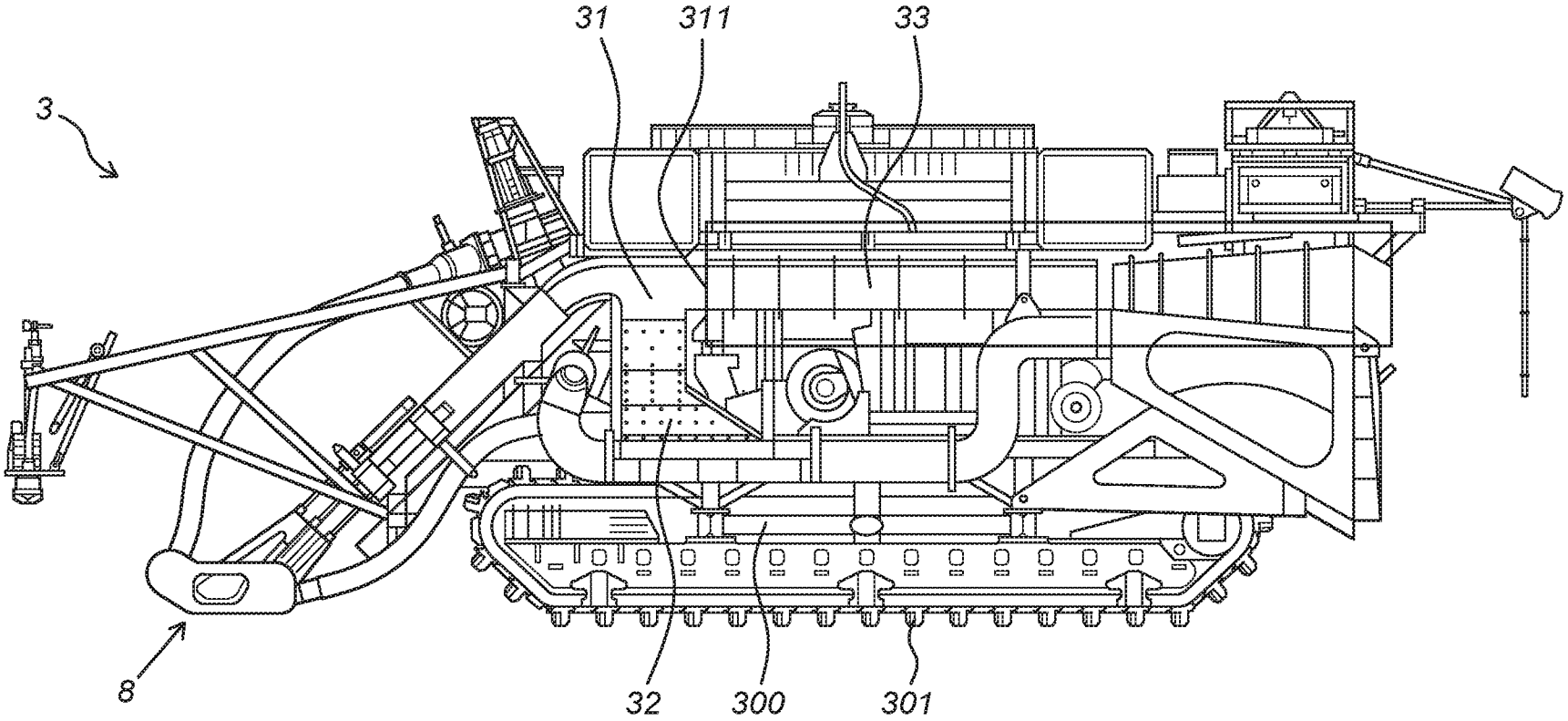
FIG. 2 is a schematic side view of a deep-sea mining vehicle according to an embodiment of the invention.

FIG. 2 shows a deep-sea mining vehicle 3 according to a preferred embodiment of the invention. Deep-sea mining vehicle 3 typically comprises a support frame 300 which is provided with means 301 for enabling deep-sea mining vehicle 3 to be moved, for instance over the seabed. Such means can take the form of caterpillar tracks 301, wheels or other moving means.

In order to be able to take up mineral deposits support frame 300 is typically provided with a nodule collecting head 8, a hopper 32 and an outlet 33. A mixture of, among other things, water and mineral deposit, which is taken up by nodule collecting head 8, is transported from the seabed into deep-sea mining vehicle 3. In deep-sea mining vehicle 3, particularly in separating space 31, the mixture is split into at least two parts, for instance by arranging a filter 311 at an entrance of outlet 33. The mineral nodules are thus separated from the greater part of the water and several finer particles of the mixture. The water and finer particles of the mixture are ejected via outlet 33, back into the surrounding area.

The mineral nodules are captured in hopper 32, which in this case serves as storage or as temporary storage. When deep-sea mining vehicle 3 forms part of a deep-sea mining setup as shown in FIG. 1, mineral nodules are pumped via this storage, optionally via a central discharge pipe of deep-sea mining vehicle 3, to the hose 40. In another embodiment it is possible for deep-sea mining vehicle 3 to be provided with a nodule bin for collecting the mineral nodules.

Figure 3:
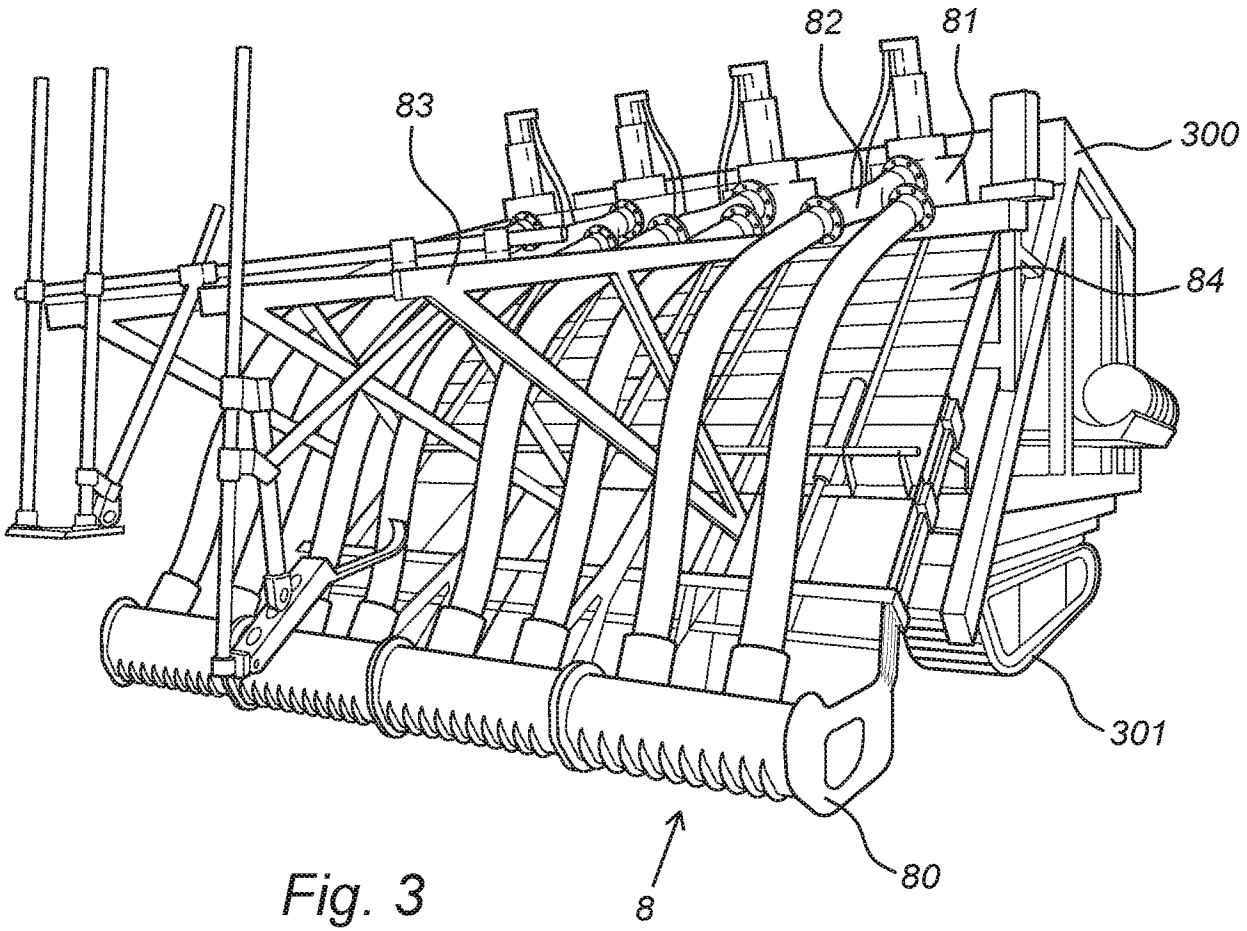
FIG. 3 is a schematic perspective front view of a deep-sea mining vehicle according to an embodiment of the invention.

FIG. 3 shows a schematic perspective front view of deep-sea mining vehicle 3 according to an embodiment of the invention. From this perspective, it can once again be seen that deep-sea mining vehicle 3 comprises support frame 300 and caterpillar tracks 301. This perspective particularly shows that deep-sea mining vehicle 3 can, in addition to one, also comprise a plurality of nodule collecting heads 8 disposed parallel to each other.

In a situation of use such nodule collecting heads 8 spray water onto the seabed at a high speed so as to thus mix mineral deposit situated there with the supplied and surrounding water.

These nodule collecting heads 8 typically consist of pump 81, which provides water via one or more supply conduits to suction head 80 at a high pressure. Pump 81 can also be shared between two or more nodule collecting heads, wherein it provides water to both heads. From suction head 80 water is sprayed onto the seabed at high speed, such that mineral deposits which may be situated there are mixed with the supplied and surrounding water. This mixture of water and seabed is taken up via the nodule collecting heads into deep-sea mining vehicle 3, after which it is processed as described above with reference to FIG. 2. From head 80, the mixture is received by means of suction conduit 84 in nodule collecting head 8.

The one or more nodule collecting heads 8 can be controlled on the basis of measurements taken of the surrounding area via a measuring installation mounted on a measuring installation frame 83.

Figure 4:
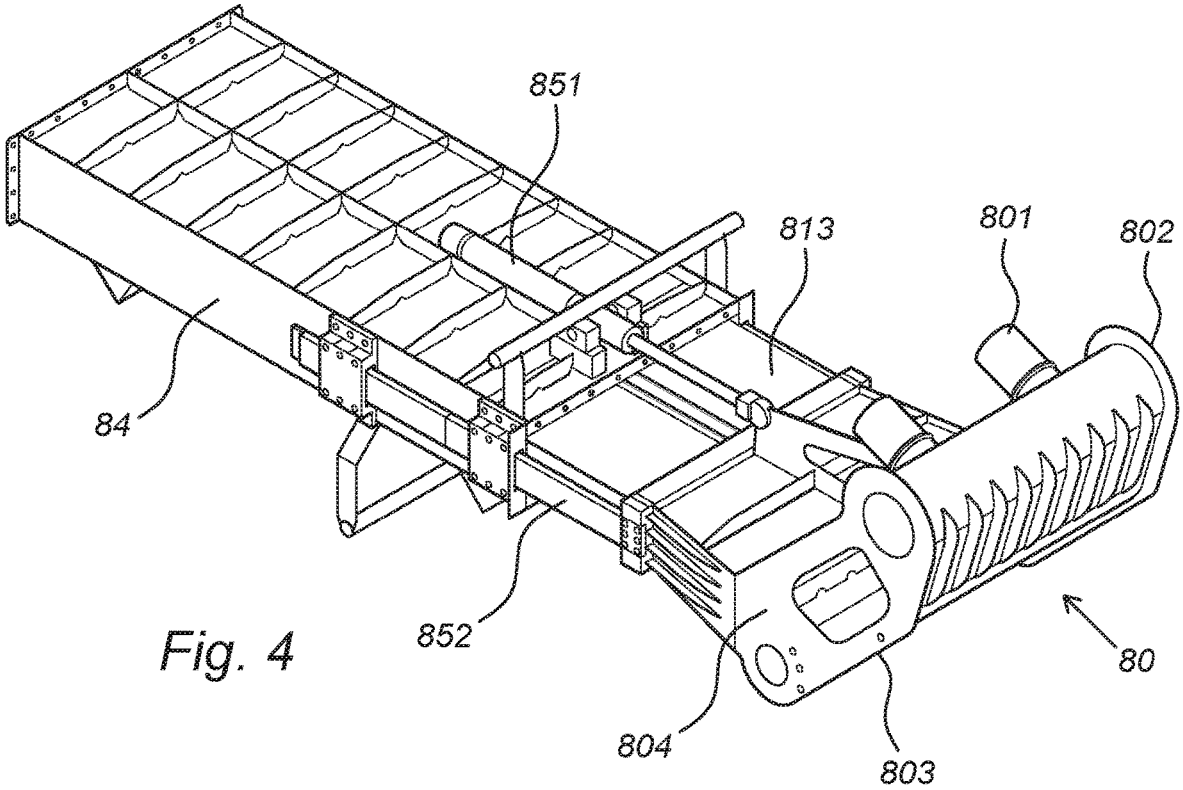
FIG. 4 is a schematic perspective front view of a suction head of the deep-sea mining vehicle according to an embodiment of the invention.
Figure 5:
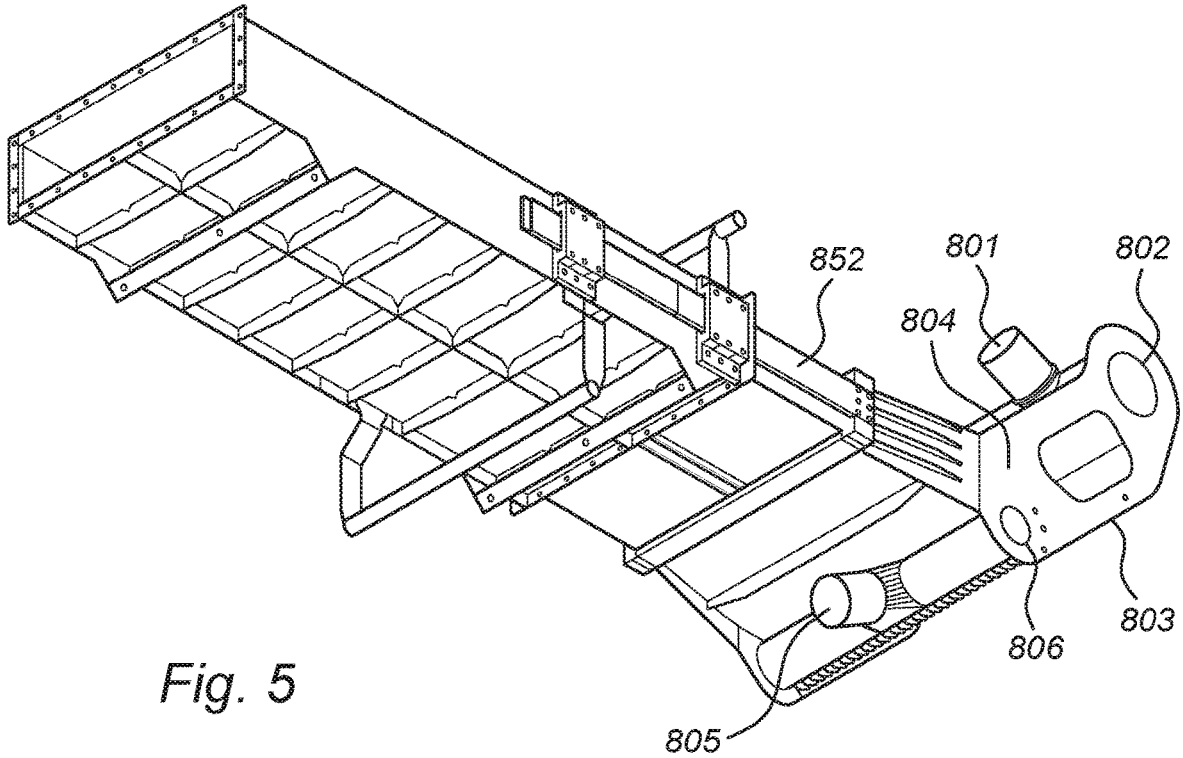
FIG. 5 is a schematic perspective rear view of the suction head of the deep-sea mining vehicle according to an embodiment of the invention shown in FIG. 4.

FIGS. 4 and 5 show respectively a schematic, perspective front and rear view of suction head 80 as part of nodule collecting head 8 of deep-sea mining vehicle 3, according to an embodiment of the invention. From this perspective it can once again be seen that nodule collecting head 8 consists, among other things, of suction head 80 and suction conduit 84. It can particularly be seen from this perspective that suction head 80 lies partially in suction conduit 84, wherein these elements are mutually connected by a height-adjusting actuator 851 and a guiding installation 852. Outlet 813, which has an outer periphery corresponding with an opening in suction conduit 84, is particularly arranged at least partially in suction conduit 84. Height-adjusting actuator 851 enables suction head 80 and suction conduit 84 to be adjustable relative to each other. This is achieved by moving outlet 813 into or out of suction conduit 84. Guiding installation 852 is arranged in order to further support this linear movement.

It can also be seen from this perspective that suction head 80 further consists of one or more water inlets 801, pressure chamber 802, open suction side 803, outlet 813, and an optional active suction space 804. Water which is provided from supply conduit 82 and is already under high pressure is collected in pressure chamber 802 via one or more water inlets 801. From pressure chamber 802, the provided water is sprayed at high speed into open suction side 803, particularly in the direction of the outlet.

When a nodule collecting head 8, of which suction head 80 forms part, is installed on deep see mining vehicle 3, open suction side 803 is directed in an environment of use toward the bottom on which deep-sea mining vehicle 3 rests, for instance the seabed. In a collecting head 8 installed in such a manner the longitudinal axis of suction conduit 84 preferably forms an angle with a horizontal plane of between 30 and 80 degrees, and more preferably between 40 and 50 degrees.

By aiming the water flow over the seabed a water flow is realized from pressure chamber 802 to suction conduit 84, and in this way the mixture of water and mineral deposit is sucked into suction conduit 84. The flow of this mixture into suction conduit 84 can be strengthened in active suction space 804 by spraying water into suction conduit 84 at high speed in suction direction of suction conduit 84. Water is supplied under high pressure to active suction space 804 via secondary water inlet 805. For this purpose the water can further be brought under pressure by a pump, for instance pump 81, and be provided to secondary water inlet 805 by a supply conduit, similar to supply conduit 82. With such an approach both mineral deposits situated on the seabed and mineral deposits buried partially under the seabed can be drawn up.

Figure 6:
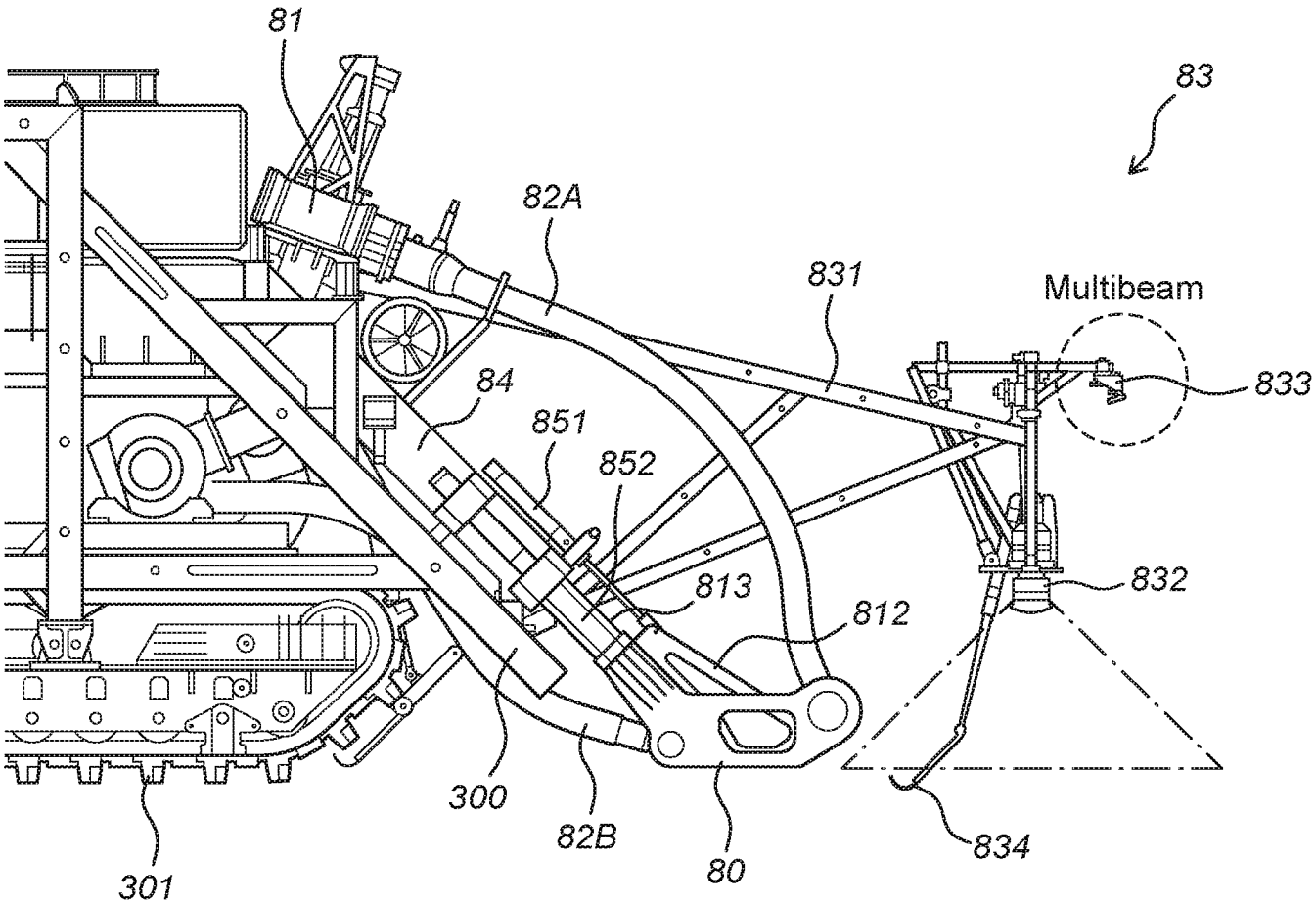
FIG. 6 is a specified schematic side view of the deep-sea mining vehicle according to an embodiment of the invention shown in FIG. 1.

FIG. 6 shows a part of deep-sea mining vehicle 3. In this view it can once again be seen that deep sea vehicle 3 consists of support frame 300, which rests on caterpillar tracks 301.

It can further be seen in this view that suction conduit 84 is mounted on support frame 300, wherein outlet 813 of suction head 80 is arranged at least partially in suction conduit 84. Measuring means 83 further comprises a support 831 from which a navigation and positioning system 832 and measuring head 833 (multibeam) are suspended. The measuring system frame 83 is also provided with a mechanical fallback system 834.

The relative displacement between suction conduit 84 and suction head 80 is controlled by height-adjusting actuator 851. In order to further support this linear movement guiding installation 852 is arranged. Guiding installation 852 serves to reduce the torsional forces on the height-adjusting actuator. Water supply to suction head 80 is possible for multiple heights of suction head 80 in that the primary supply conduit 82A and secondary supply conduit 82B are made of a flexible material. Owing to the angle at which suction conduit 84 is mounted on support frame 300, displacement of suction head 80 will also always take place at an angle, particularly the same angle. When suction head 80 is displaced upward it is thus also always displaced at least partially rearward.

This setup is particularly configured to control the distance of suction head 80 to the underlying seabed. When the deep-sea mining vehicle comprises a plurality of suction heads, these can be controlled individually in the height relative to the seabed.

The plane of suction head 80 which is directed towards the seabed, referred to hereinafter as the suction plane, is adjusted in the height by the control device in order to keep this distance within determined limits.

This is realized by measuring head 833 for obtaining seabed heights at positions which precede the open suction side relative to the direction of movement and which extend over almost the whole width of deep-sea mining vehicle 3, and by height-adjusting actuator 851 which is incorporated in the control circuit and which is configured on the basis of the seabed heights measured at the positions to adjust the height of the suction plane of suction head 80 such that it remains between the predetermined limits relative to the seabed.

Measuring head 833 comprises sources which are configured to generate a geophysical signal, for instance a sound signal, under water in the direction of the seabed, and a series of receivers configured to measure a response signal returning via the seabed, wherein the carrier extends in the width direction of deep-sea mining vehicle 3 over a width of deep-sea mining vehicle 3. In order to ensure sufficient precision over the whole width the measuring means can comprise a multibeam. Instead of measuring at 1 location, such a multibeam measures at multiple locations, for instance 256, over the whole width of the vehicle. These positions are distributed over the whole width of deep-sea mining vehicle 3, whereby the intermediate distance of two adjacent positions of which the seabed height is measured lies in the width direction between 1 and 3 cm, more preferably between 1.2 and 2.5 cm, still more preferably between 1.4 and 2 cm. In other exemplary embodiments the intermediate distance of two adjacent positions can be chosen differently.

Actuator 851 can adjust on the basis of the calculated maximum seabed height the height of the suction plane of the at least one suction head 80 such that it remains between the predetermined limits relative to the seabed.

If, despite the above stated precautionary measures, suction head 80 is disposed closer to the seabed than the above stated limits, or if measuring head 832 were to fail for other reasons, mechanical fallback system 834 in the form of one or more slats connected to carrier 831 provide a solution. These can move over the seabed in the direction of movement, and the fallback system further comprises computing means for determining a seabed height from the measured incline of the slat. Such slats can be removed from the system.

Figure 7:
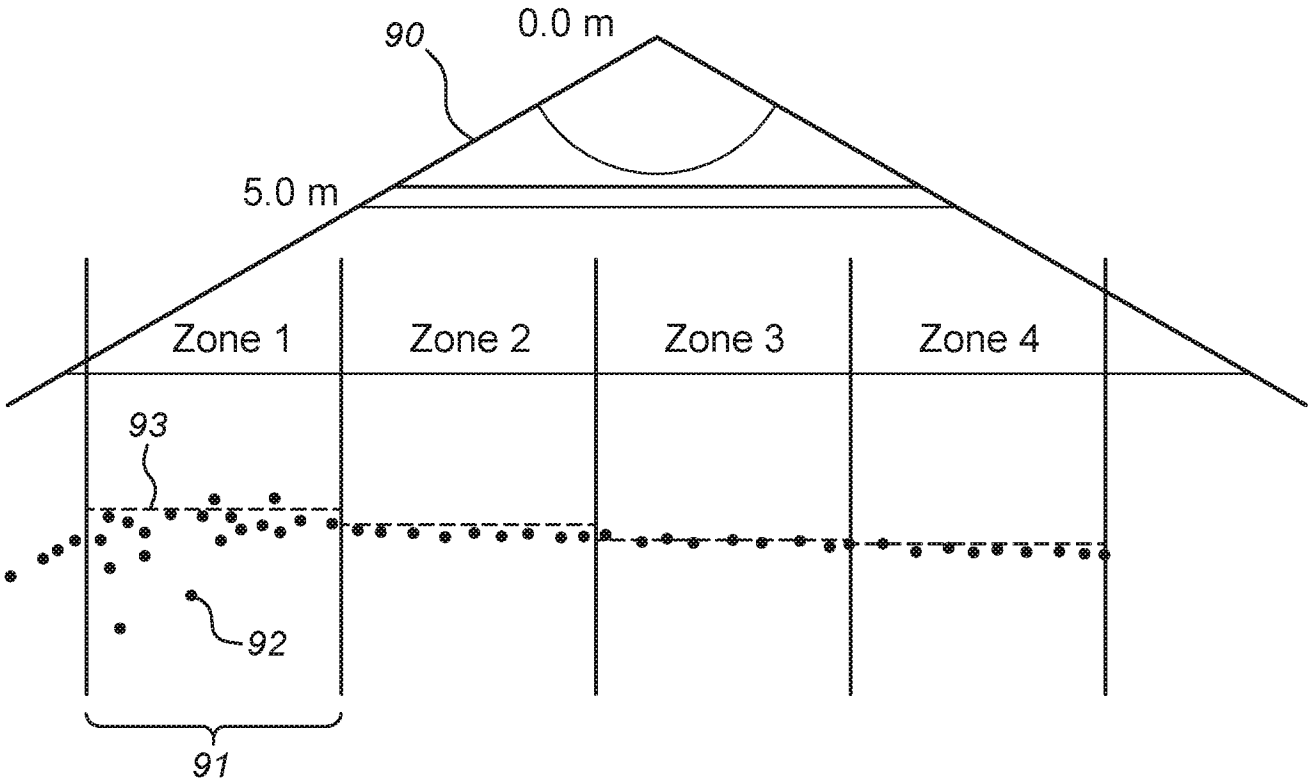
FIG. 7 is a visualization of measurements of the deep sea floor height obtained by the measuring means arranged on the deep-sea mining vehicle.

FIG. 7 shows a schematic representation of such measurements. This figure shows a plurality of measuring points 92, measured by measuring heads 833, 832 and always arranged within an extreme measuring range 90. Measuring range 90 is divided into different zones, wherein a single zone 91 corresponds with a suction head 80 arranged at this width of deep-sea mining vehicle 3. All the zones together therefore roughly correspond with the whole width of deep-sea mining vehicle 3.

For a single suction head 80 the height to be set is determined on the basis of measurement 92 performed in the relevant zone. In order to prevent suction head 80 from being wrongfully lifted and thus lowering the suction capacity the measured seabed heights can be filtered of outliers. When there are enough measurements per width of suction head 80, it is safe to assume that the farthest outliers are caused by measurement errors. From the remaining measurements a maximum seabed height can further be calculated over the width of this suction head 80.

In order to prevent suction head 80 from constantly being moved upward and downward a number of successive measurements is taken over a predefined period of time, and an average value thereof is determined as desired height 93 of suction head 80. It is hereby possible that desired height 93 is not adjusted in time in the case of an unexpected, steep change, whereby it must be taken into account when setting up the above stated measuring system that a minimal amount of scraping over the bottom will have to be accepted.

The invention is not limited to the above described embodiment and also comprises modifications thereto to the extent these fall within the scope of the claims appended below.

The invention claimed is:

1. A deep-sea mining vehicle for taking up mineral deposits from a seabed at great depth, wherein the vehicle comprises:

a support frame provided with means for moving the vehicle forward on the seabed in a direction of movement, with a storage for the mineral deposits taken up, and with at least one suction head with an open suction side which is directed toward the seabed and is provided in a suction plane, and along which the mineral deposits are taken up, wherein a width direction of the at least one suction head coincides with a width direction of the deep-sea mining vehicle, wherein the deep-sea mining vehicle is provided with a control device for keeping the height of the suction plane within predetermined limits relative to the seabed, wherein the control device comprises measuring means for obtaining seabed heights at positions which precede the open suction side relative to the direction of movement and which extend over a width of the deep-sea mining vehicle, a second measuring means for obtaining seabed heights at positions which precede the open suction side relative to the direction of movement and which extend over a width of the deep-sea mining vehicle wherein the second measuring means comprise a slat which is connected to the frame and can move over the seabed in the direction of movement, and comprises computing means for determining a seabed height from the measured incline of the slat, and an actuator which is incorporated in a control circuit and which is configured on the basis of the seabed heights measured at the positions to adjust the height of the suction plane of the at least one suction head such that it remains between the predetermined limits relative to the seabed, wherein the measuring means comprise an elongate carrier which precedes the open suction side and the support frame relative to the direction of movement, wherein the elongate carrier is provided with a series of sources, the series of sources being suspended from the elongate carrier and the support frame, the series of sources configured to generate a geophysical signal under water in the direction of the seabed, and with a series of receivers configured to measure a response signal returning via the seabed, wherein the carrier extends in the width direction of the deep-sea mining vehicle over a width of the deep-sea mining vehicle, wherein the at least one suction head has a width, the seabed heights measured in the width direction of the deep sea mining vehicle are filtered of outlying values, a subset of seabed heights over the width of the at least one suction head is determined, and a maximum seabed height over the width of the at least one suction head is calculated from the subset, wherein the actuator is configured on the basis of the calculated maximum seabed height to adjust the height of the suction plane of the at least one suction head such that it remains between the predetermined limits relative to the seabed.

2. The deep-sea mining vehicle according to claim 1, wherein the geophysical signal comprises a sound wave.

3. The deep-sea mining vehicle according to claim 1, wherein the measuring means comprise a multibeam.

4. The deep-sea mining vehicle according to claim 1, wherein the number of positions of which the seabed height is measured lies in width direction between 1 and 400.

5. The deep-sea mining vehicle according to claim 1, wherein the intermediate distance of two adjacent positions of which the seabed height is measured lies in width direction between 1 and 3 cm.

6. The deep-sea mining vehicle according to claim 1, comprising at least two suction heads disposed parallel to each other in the width direction of the deep-sea mining vehicle.

7. The deep-sea mining vehicle according to claim 6, comprising 2 to 10 suction heads.

8. The deep-sea mining vehicle according to claim 6, wherein the suction heads are controlled individually in the height relative to the seabed.

9. The deep-sea mining vehicle according to claim 1, wherein the predetermined limits amount to 20 and 100 mm.

10. The deep-sea mining vehicle according to claim 1, wherein the measuring means precede a front side of the open suction side of the at least one suction head relative to the direction of movement by a preceding distance lying between 5 and 100 cm.

11. The deep-sea mining vehicle according to claim 1, wherein the slat is removable from the seabed.

12. A method for taking up mineral deposits on a seabed at great depth, the method comprising of providing a deep-sea mining vehicle according to claim 1, connecting the deep-sea mining vehicle to a suspension cable provided between a floating device and the deep-sea mining vehicle, lowering the deep-sea mining vehicle toward a seabed, and moving the deep-sea mining vehicle forward over or on the seabed in order to take up the mineral deposits.

13. The method according to claim 12, further comprising the step of transporting deposits to the floating device.

14. The deep-sea mining vehicle according to claim 1, wherein the number of positions of which the seabed height is measured lies in width direction between 100 and 350.

15. The deep-sea mining vehicle according to claim 1, wherein the number of positions of which the seabed height is measured lies in width direction between 200 and 300.

16. The deep-sea mining vehicle according to claim 1, wherein the intermediate distance of two adjacent positions of which the seabed height is measured lies in width direction between 1.2 and 2.5 cm.

17. The deep-sea mining vehicle according to claim 1, wherein the intermediate distance of two adjacent positions of which the seabed height is measured lies in width direction between 1.4 and 2 cm.

18. The deep-sea mining vehicle according to claim 6, comprising 3 to 5 suction heads.

19. The deep-sea mining vehicle according to claim 1, wherein the predetermined limits amount to 0 mm and 200 mm.

* * * * *